US009024855B2

(12) United States Patent
Otsuka et al.

(10) Patent No.: US 9,024,855 B2
(45) Date of Patent: May 5, 2015

(54) INFORMATION PROCESSING APPARATUS AND DISPLAY CONTROL METHOD

(71) Applicant: Fujitsu Limited, Kawasaki (JP)

(72) Inventors: Katsumi Otsuka, Kawasaki (JP); Naoyuki Sawasaki, Kawasaki (JP); Yoku Takahashi, Minato (JP); Tomohiro Nakajima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 38 days.

(21) Appl. No.: 13/852,560

(22) Filed: Mar. 28, 2013

(65) Prior Publication Data

US 2013/0278643 A1 Oct. 24, 2013

(30) Foreign Application Priority Data

Apr. 19, 2012 (JP) ..... 2012-095989

(51) Int. Cl.

| | |
|---|---|
| ***G09G 3/36*** | (2006.01) |
| ***G09G 1/00*** | (2006.01) |
| ***G09G 5/02*** | (2006.01) |

(52) U.S. Cl.

CPC ..... *G09G 1/002* (2013.01); *G09G 5/02* (2013.01); *G09G 2320/0242* (2013.01); *G09G 2320/0666* (2013.01); *G09G 2360/144* (2013.01); *G09G 2360/16* (2013.01)

(58) Field of Classification Search

CPC ..... G09G 2320/0666; G09G 2320/0653; G09G 2320/0276; G09G 2320/0626

USPC ..... 345/87–100, 102, 204, 690

See application file for complete search history.

(56) References Cited

U.S. PATENT DOCUMENTS

| | | | | |
|---|---|---|---|---|
| 7,079,155 | B2 | 7/2006 | Kanai | |
| 2007/0222730 | A1 * | 9/2007 | Kao et al. | 345/89 |
| 2009/0237423 | A1 * | 9/2009 | Shih et al. | 345/690 |
| 2010/0214325 | A1 | 8/2010 | Koyama et al. | |

FOREIGN PATENT DOCUMENTS

| | | |
|---|---|---|
| CN | 101821795 | 9/2010 |
| EP | 2202717 A1 | 6/2010 |

(Continued)

OTHER PUBLICATIONS

Extended European Search Report dated Jul. 25, 2013 for corresponding European Application No. 13161972.8.

(Continued)

*Primary Examiner* — Jennifer Nguyen

(74) *Attorney, Agent, or Firm* — Fujitsu Patent Center

(57) ABSTRACT

An information processing apparatus is disclosed, including a detection part, a change part, and a determination part. The detection part detects a change of a first color temperature of an external environment. The change part changes a second color temperature of a display part at a predetermined speed to a targeted value corresponding to the first color temperature after the change in response to a detected change of the first color temperature. The determination part determines whether brightness of an image is changed, in response to a switch of the image on the display part. When it is determined that the brightness of the image on the display part is changed during the change of the second color temperature of the display part, the change part changes the second color temperature of the display part at a different speed from the predetermined speed.

6 Claims, 11 Drawing Sheets

(56) References Cited

FOREIGN PATENT DOCUMENTS

| | | | |
|---|---|---|---|
| JP | 06-261334 | | 9/1994 |
| JP | 2009-267967 | | 11/2009 |
| WO | WO-2011/103377 | A1 | 8/2011 |

OTHER PUBLICATIONS

CNOA—Office Action mailed on Dec. 2, 2014 issued with respect to the corresponding Chinese Patent Application No. 201310128356.9.

* cited by examiner

INFORMATION PROCESSING APPARATUS AND DISPLAY CONTROL METHOD

CROSS-REFERENCE TO RELATED APPLICATIONS

This patent application is based upon and claims the benefit of priority of the prior Japanese Patent Application No. 2012-095989 filed on Apr. 19, 2012, the entire contents of which are incorporated herein by reference.

FIELD

The embodiments discussed herein are related to an information processing apparatus and a display control method.

BACKGROUND

Color temperature is known as a parameter for a display device such as a monitor of a television set or an electronic device, or the like. Whether under a fluorescent lamp of a daylight color, under a fluorescent lamp of an electric bulb color, under direct sunlight, or the like, the look of a screen may become greatly different depending on the strength or weakness of the light of a peripheral environment. Each environment has a different color temperature. Human eyes adjust themselves to the change of the color temperature and can distinguish color. If human eyes look at a paper which is seen as white under direct sunlight, the paper appears to have a red hue. With a time lapse, the paper looks white. This characteristic of human eyes is called "chromatic adaptation".

Accordingly, in order to acquire color which is closer to the original color of an article displayed on the screen, it is demanded to properly adjust the color temperature of the display device. In a case of displaying an image seen as white under direct sunlight on the display device under the fluorescent lamp of an electric bulb as its natural color, the image may look blue to human eyes.

Conventionally, a display device, which can automatically execute an adjustment of the color temperature, is proposed.

However, in a case in which an image as a display target is changed and brightness becomes different between moment before and after the image changes, the change of the color temperature of the display device may appear artificial to human eyes.

When the display target is changed from a bright image to a dark image, for human eyes, the color temperature may be adjusted unnaturally as if the color temperature is suddenly changed. Human eyes easily follow the change from the dark image to the bright image, but do not easily follow its opposite change.

Patent Documents

Japanese Laid-open Patent Publication No. H06-261334
Japanese Laid-open Patent Publication No. 2009-267967

SUMMARY

According to one aspect of the embodiment, there is provided an information processing apparatus including a detection part configured to detect a change of a first color temperature of an external environment; a change part configured to change a second color temperature of a display part at a predetermined speed to a targeted value corresponding to the first color temperature after the change in response to a detected change of the first color temperature; and a determination part configured to determine whether brightness of an image is changed, in response to a switch of the image on the display part, wherein when it is determined that the brightness of the image on the display part is changed during the change of the second color temperature of the display part, the change part changes the second color temperature of the display part at a different speed from the predetermined speed.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

In the following, embodiments of the present invention will be described with reference to the accompanying drawings.

Figure 1:
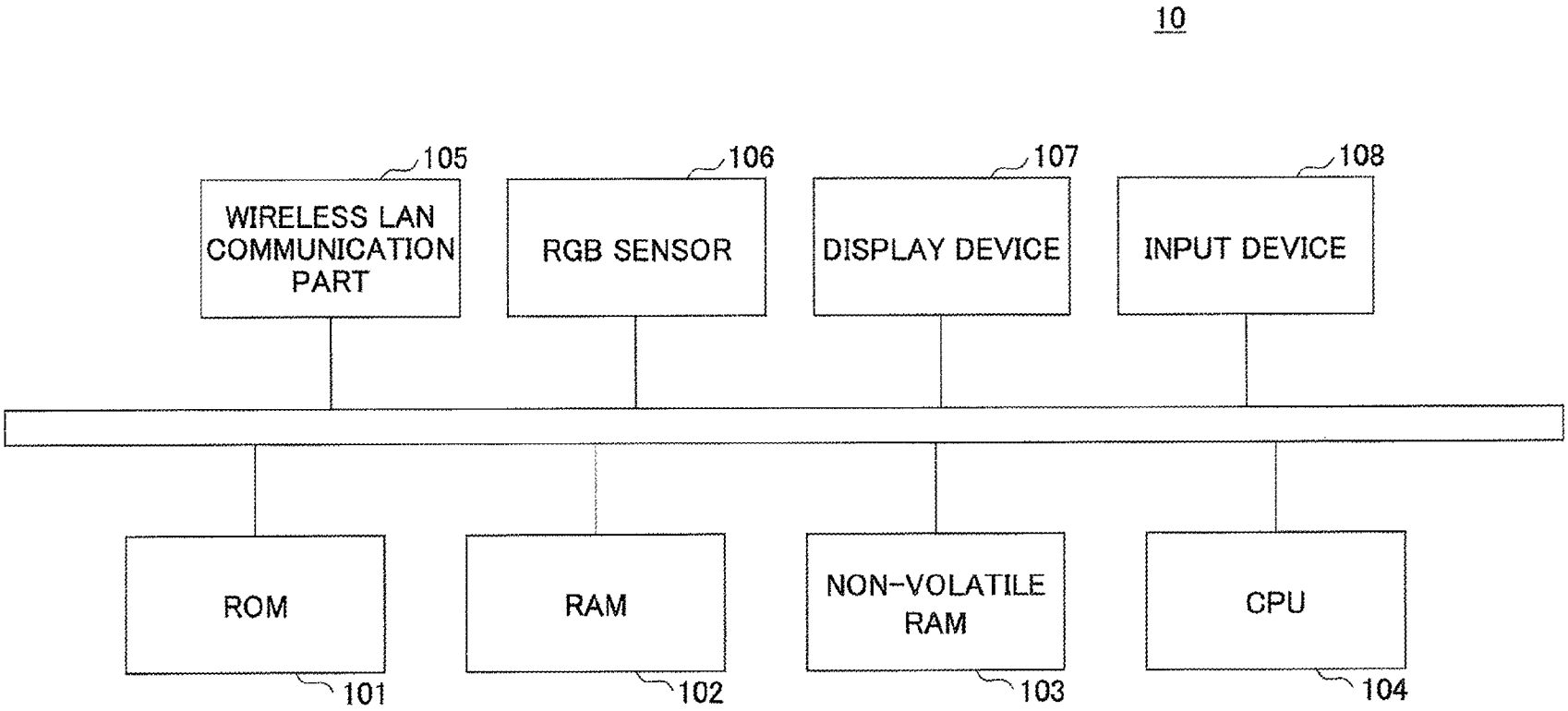
FIG. 1 is a diagram illustrating an example of a hardware configuration of an information processing apparatus in an embodiment.

FIG. 1 is a diagram illustrating an example of a hardware configuration of an information processing apparatus in an embodiment. In FIG. 1, an information processing apparatus 10 includes a ROM 101, a RAM 102, a non-volatile RAM 103, a CPU (Central Processing Unit) 104, a wireless LAN communication part 105, a RGB (Red-Green-Blue) sensor 106, a display device 107, an input device 108, and the like.

A program to conduct a process in the information processing apparatus 10 is installed into the ROM 101 or the non-volatile RAM 103. The program may be stored in the ROM 101 in a case of being installed beforehand when the information processing apparatus 10 is shipped. In the ROM 101 or the non-volatile RAM 103, various data sets used by the program may be stored as well as the program. When the CPU 104 is instructed to activate the program, the RAM 102 stores the program or the like which are read from the ROM 101 or the non-volatile RAM 103. The CPU 104 performs functions according to the information processing apparatus 10, which will be described later, in accordance with the program stored in the RAM 102. The wireless LAN communication part 105 may be regarded as hardware to conduct a wireless LAN communication. The wireless LAN communication part 105 may include an antenna for the wireless LAN communication. The RGB sensor 106 may be regarded as hardware to detect or measure color temperature of an external environment of the information processing apparatus 10. The display device 107 displays various information items output by the program. The input device 108 may be regarded as a touch panel, buttons, or the like to accept an input instruction from a user.

As an example of the information processing apparatus 10, a smart phone, a mobile phone, a PDA (Personal Digital Assistance), a tablet type terminal, a PC (Personal Computer), and the like may be used.

Figure 2:
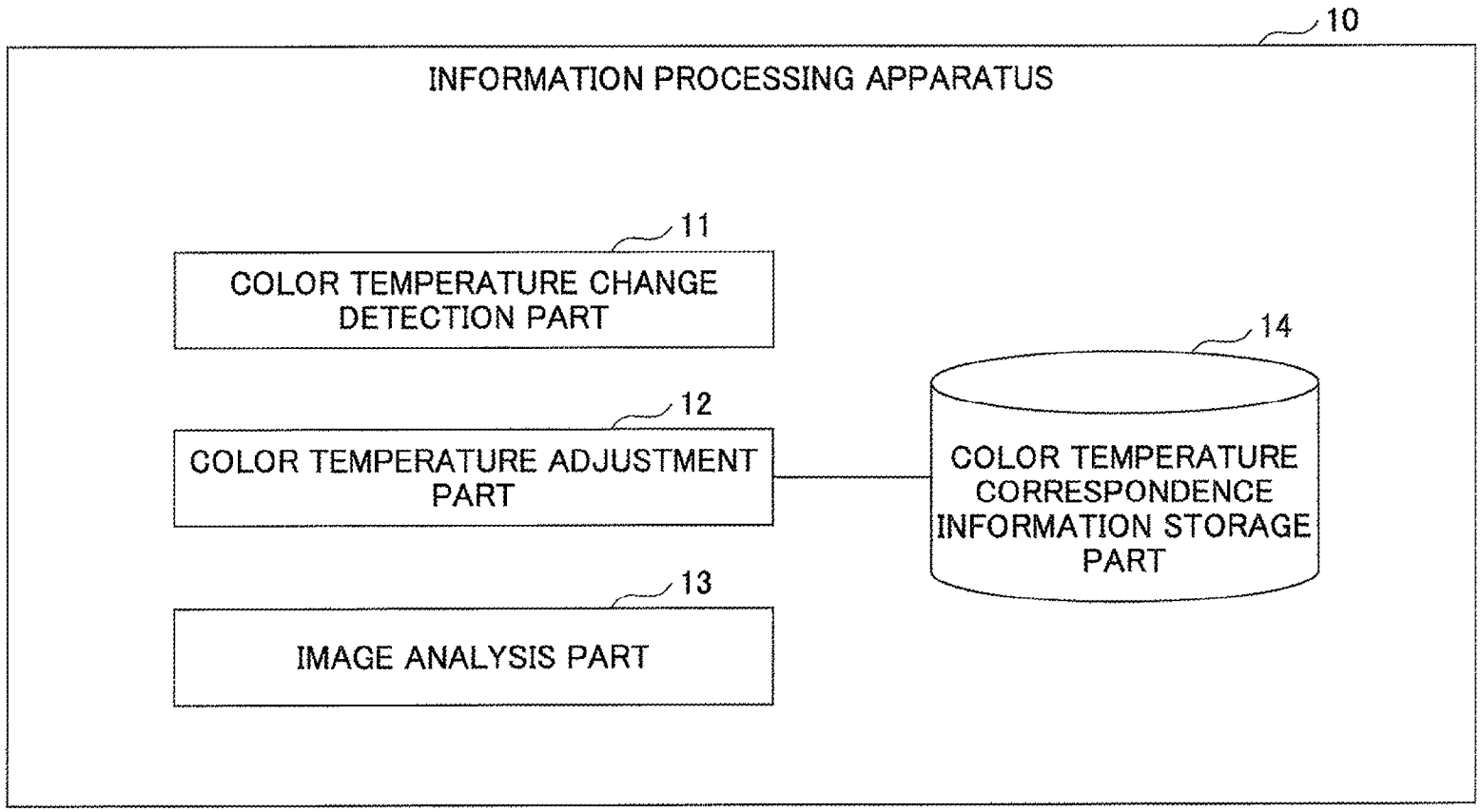
FIG. 2 is a diagram illustrating an example of a functional configuration of the information processing apparatus in the embodiment.

FIG. 2 is a diagram illustrating an example of a functional configuration of the information processing apparatus 10 in the embodiment. In FIG. 2, the information processing apparatus 10 includes a color temperature change detection part 11, a color temperature adjustment part 12, an image analysis part 13, and the like. These parts are realized by corresponding processes performed by the program which is installed to the information processing apparatus 10 and executed by the CPU 104. The information processing apparatus 10 also includes a color temperature correspondence information storage part 14. It is possible to realize the color temperature correspondence information storage part 14 by using the ROM 101, the non-volatile RAM 103, or the like.

The color temperature change detection part 11 detects the change of the color temperature of the external environment which is detected by the RGB sensor 106. When the change of the color temperature of the external environment is detected by the color temperature change detection part 11, the color temperature adjustment part 12 adjusts (or corrects) to a value suitable for the color temperature after the external environment is changed. The color temperature correspondence information storage part 14 stores the value of the color temperature of the display device 107 suitable for each of the external environments.

The image analysis part 13 determines the presence or absence of a brightness change of an image (hereinafter, called "display image") displayed on the display device 107 before or after the change, as if contents to be a display target of the information processing apparatus 10 are changed.

Figure 3:
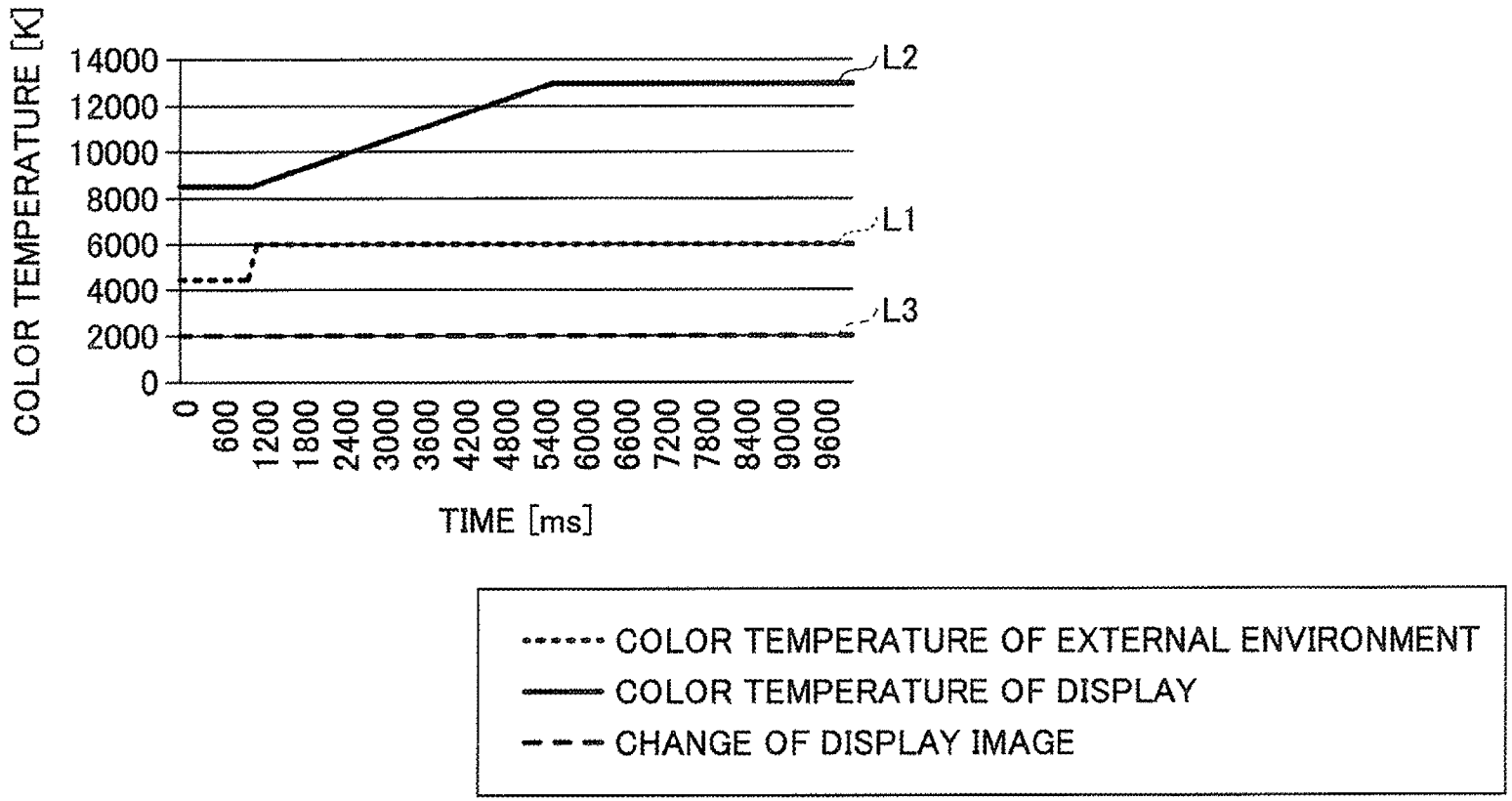
FIG. 3 is a graph for explaining an example of an automatic adjustment of a color temperature in a case in which there is no change of a display image.
Figure 4:
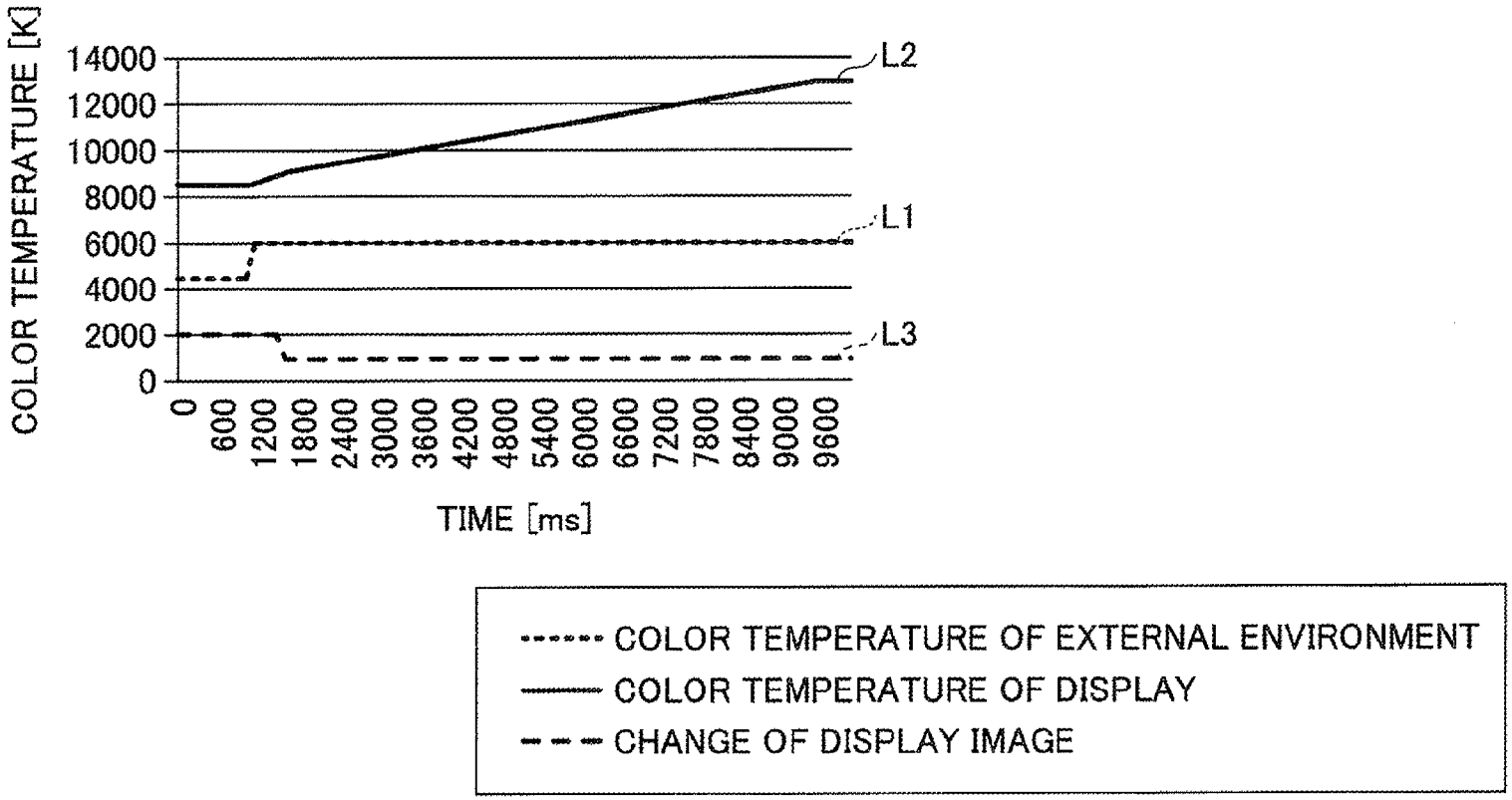
FIG. 4 is a graph illustrating an example of the automatic adjustment of the color temperature in a case in which the display image is changed to a darker image.
Figure 5:
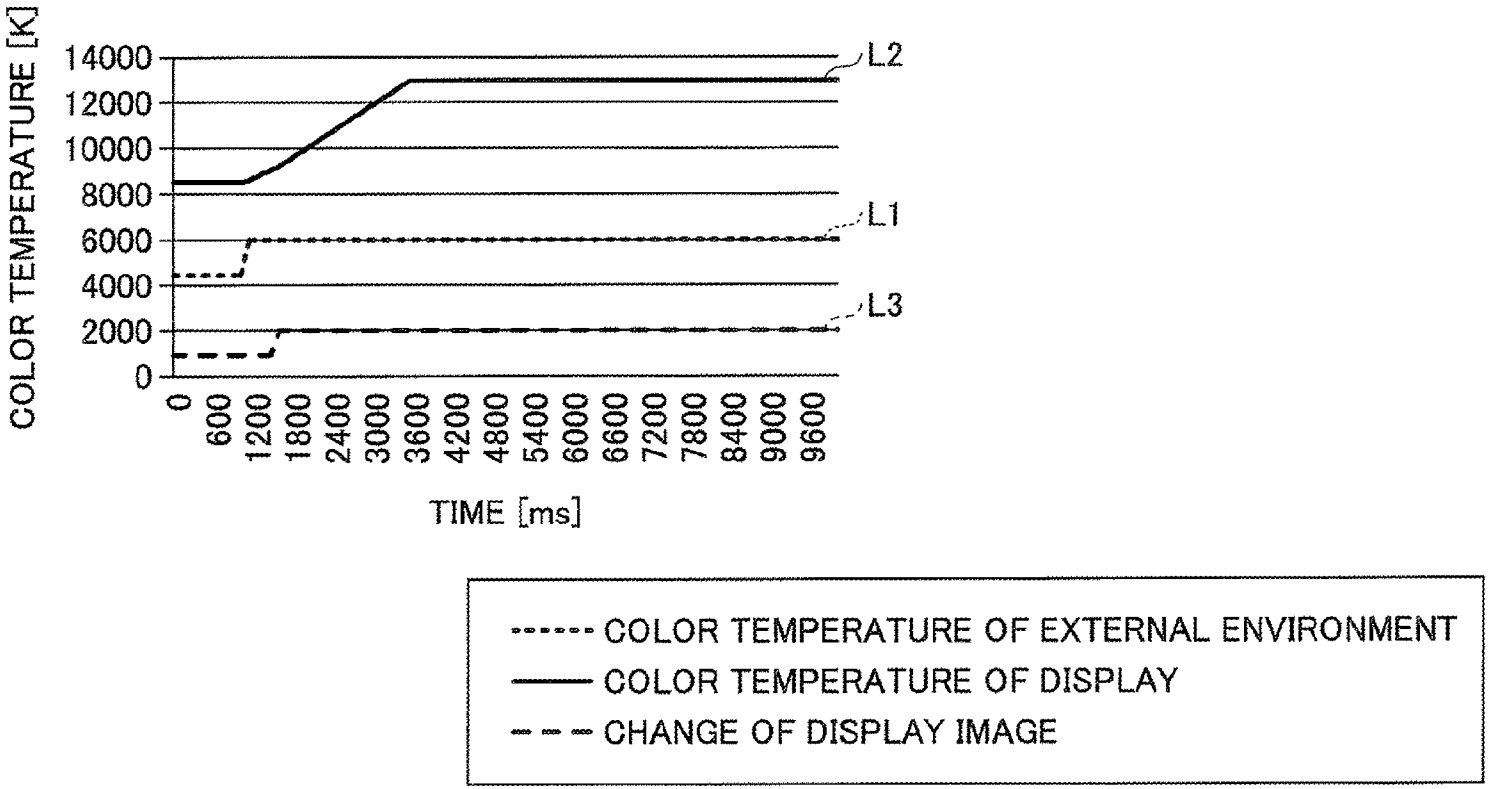
FIG. 5 is a graph illustrating an example of the automatic adjustment of the color temperature in a case in which the display image is changed to a brighter image.

By the functional configuration as illustrated in FIG. 2, the information processing apparatus 10 executes an automatic adjustment pertinent to the color temperature of the display device 107 as illustrated in FIG. 3 through FIG. 5.

FIG. 3 is a graph for explaining an example of the automatic adjustment of the color temperature in a case of in which the display image is not changed.

In a graph in FIG. 3, a line L1 indicates the color temperature detected by the RGB sensor 106, that is, the change of the color temperature of the external environment. A line L2 indicates an adjustment result by the color temperature adjustment part 12, that is, it indicates the change of the color temperature of the display device 107. A line L3 indicates the presence or absence of the change of the display image. In FIG. 3, since the display image is not changed, the line L3 indicates a straight line. In FIG. 3, a horizontal axis indicates time lapse, and a vertical axis indicates the color temperature. A unit of the color temperature is Kelvin (K). However, values of the vertical axis are valid only for the line L1 and the line L2.

As illustrated in FIG. 3, the color temperature adjustment part 12 changes the color temperature of the display device 107 to a targeted value by a constant rate (speed) in response to the change of the color temperature of the external environment. The targeted value may be regarded as the color temperature suitable for the color temperature of the external environment. In an example of FIG. 3, since the color temperature of the external environment becomes higher, the color temperature of the display device 107 is adjusted to be higher.

FIG. 4 is a graph illustrating an example of the automatic adjustment of the color temperature in a case in which the display image is changed to the dark image. In FIG. 4, portions that are the same as those illustrated in FIG. 3 are given by the same reference numbers.

The line L3 in FIG. 4 is bent at a certain time point. This indicates that the display image changes to a dark image at a certain time point. That is, this case in FIG. 4 corresponds to when the color temperature of the external environment becomes higher and the display image changes to a relatively dark image during the automatic adjustment. In this case, the color temperature adjustment part 12 decreases the speed of changing the color temperature of the display device 107 to the targeted value. Human eyes do not easily follow the change from the bright image to the dark image. By this operation, it is possible to change the color temperature of the display device 107 at the speed corresponding to an adjustment of human eyes for a change from brightness to darkness.

FIG. 5 is a graph illustrating an example of the automatic adjustment of the color temperature in a case in which the display image changes to a bright image. In FIG. 5, portions that are the same as those illustrated in FIG. 3 are given by the same reference numbers.

In FIG. 5, the line L3 is elevated toward an upper side at a certain time point. This indicates that the display target is switched to bright contents at the certain time point. That is, this case in FIG. 5 corresponds to when the color temperature of the external environment becomes higher, and the display image changes to a relatively bright image during the automatic adjustment. In this case, the color temperature adjustment part 12 increases the speed for changing the color temperature of the display device 107 to the targeted value. Human eyes easily follow the change from the dark image to the bright image. By this operation, it is possible to change the color temperature of the display device 107 at the speed corresponding to an adjustment of human eyes for a change from darkness to brightness. Also, the automatic adjustment time of the color temperature becomes shorter, and it is possible to suppress power consumption.

FIG. 3 through FIG. 5 illustrate a case in which the color temperature of the external environment is described. On the other hand, in a case in which the color temperature of the external environment, the color temperature adjustment part 12 decreases the color temperature of the display device 107 at the same speed. That is, when the display image changed to the dark image, the color temperature is adjusted at a slower speed than that in FIG. 3. When the display image changes to the bright image, the color temperature is adjusted at a higher speed.

In the following, in order to realize the automatic adjustment of the color temperature as illustrated in FIG. 3 through FIG. 5, a process procedure executed by the information processing apparatus 10 will be described.

Figure 6A:
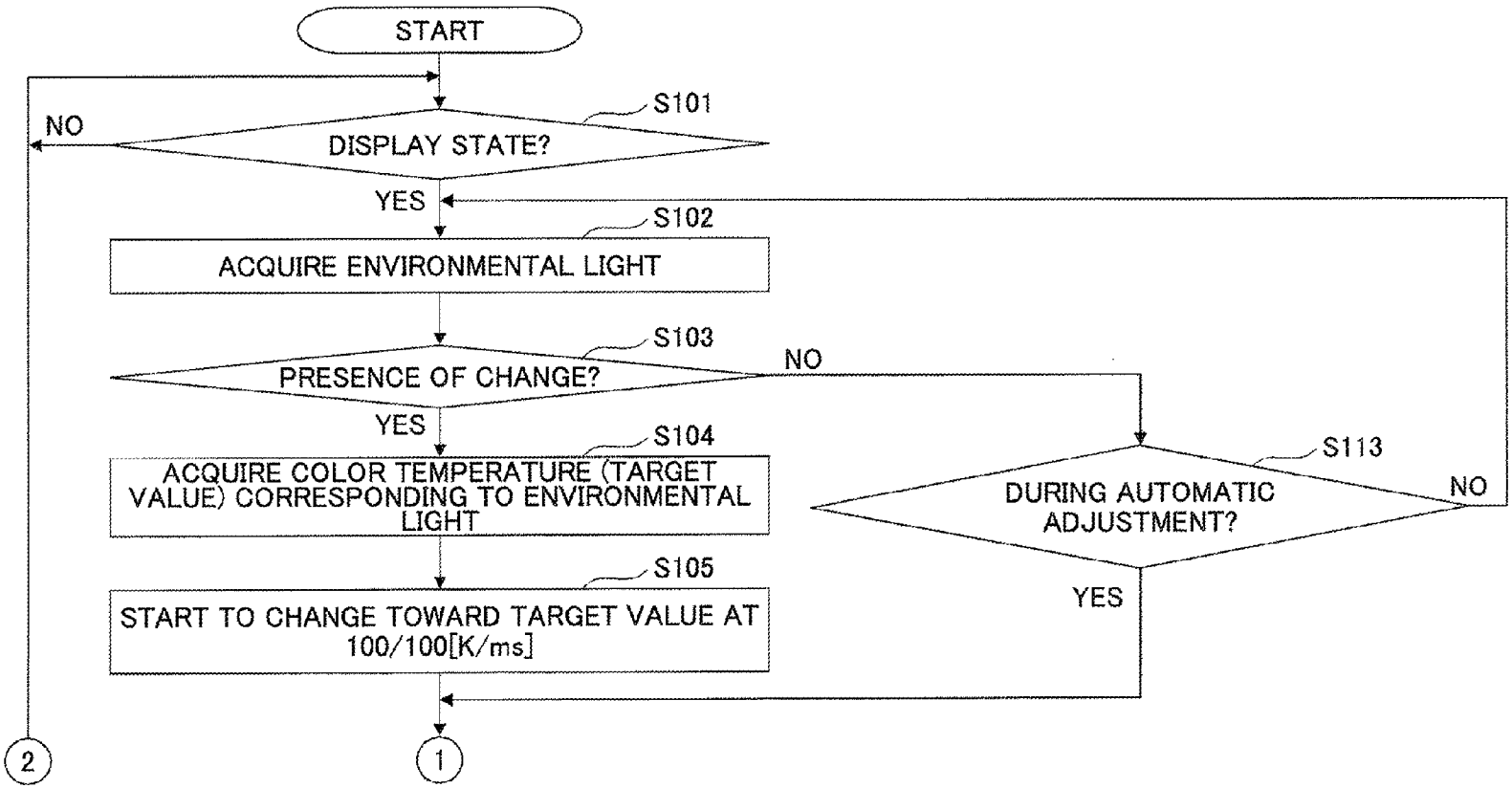
FIG. 6A and FIG. 6B illustrate a flowchart for explaining an example of a process procedure of an automatic adjustment process of the color temperature.
Figure 6B:
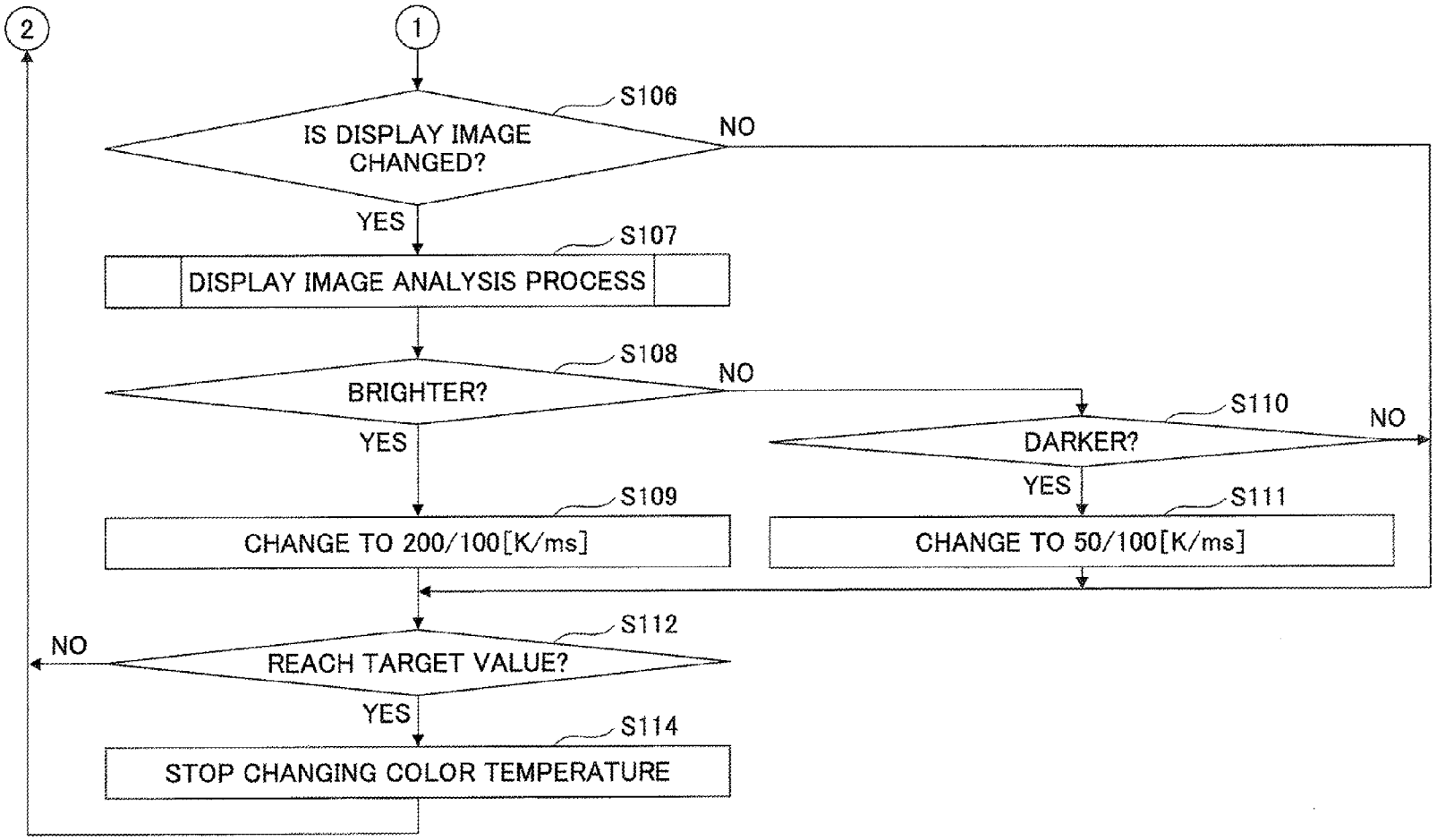

FIG. 6A and FIG. 6B illustrate a flowchart for explaining an example of the process procedure of an automatic adjustment process of the color temperature.

In step S101, the color temperature change detection part 11 determines whether the display apparatus 107 is in a display state or a non-display state. The display state may be a state in which the image is visibly displayed on a screen. The non-display state may be a state in which luminescence from the screen is stopped.

When the display device 107 is in the display state (YES in step S101), the color temperature change detection part 11 acquires the color temperature of light of the external environment (hereinafter, called "environment light") which is detected by the RGB sensor 106 (step S102). After that, the color temperature change detection part 11 determines the presence of absence of the change of the color temperature of the environment light (step S103). The acquired color temperature may be recorded in the RAM 102, and the determination may be performed by comparing a previously acquired color temperature with a currently acquired color temperature. Also, the presence or absence of the change of the color temperature may be determined depending on whether a change range of the color temperature exceeds a predetermined value.

When it is determined that the color temperature of the environment light changes (YES in step S103), the color temperature adjustment part 12 acquires the color temperature of the display device 107 suitable for the color temperature of the environment light by referring to the color temperature correspondence information storage part (step S104). Specifically, when the color temperature of the environment light and respective color temperature of the display device 107 are recorded in the color temperature correspondence information storage part 14, the color temperature of the display device 107 is acquired. Also, when the color temperature of the environment light and the respective color temperature of the display device 107 are recorded in the color temperature correspondence information storage part 14, based on values stored in the color temperature correspondence information storage part 14, the color temperature of the display apparatus 107 may be calculated by a linear interpolation. Hereinafter, the acquired color temperature is called "targeted value".

After that, the color temperature adjustment part 12 begins the change of the color temperature of the display device 107 at speed from a current color temperature to the targeted value (step S105). The speed may be 100/100 [K/ms]. As a result, the color temperature of the display device 107 may start to change at the speed of 100/100 [K/ms].

After the change of the color temperature of the display device 107 starts, the image analysis part 13 determines whether the display image changes (step S106). When the display image does not change (NO in step S106), the color temperature adjustment part 12 determines whether the color temperature of the display device 107 reaches the targeted value (step S112). When the color temperature does not reach the targeted value (NO in step S112), processes after step S101 are repeated. After that, if a state in which the color temperature of the environment light has not changed is continued (NO in step S103), and the color temperature of the display device 107 is being changed by the automatic adjustment (YES in step S113), the color temperature of the display device 107 may successively change at the speed of 100/100 [K/ms] unless the display image is switched (NO in step S106).

When the color temperature of the display device 107 reaches the targeted value (YES in step S112), the color temperature adjustment part 12 stops changing the color temperature of the display device 107 (step S114).

On the other hand, when the display image is switched after the change of the color temperature of the display device 107 begins (YES in step S106), the image analysis part 13 executes an analysis process of the display image (step S107). In the analysis process, it is determined whether the display image in the display device 107 changes to a brighter image or a darker image.

When the display image changes to the brighter image than before (YES in step S108), the color temperature adjustment part 12 increases a change speed of the color temperature of the display device 107 (step S109). The change speed of the color temperature may be changed to 200/100 [K/ms]. On the other hand, when the display image is switched to a darker image than before (YES in step S110), the color temperature adjustment part 12 decreases the change speed of the color temperature of the display device 107 (step S111). The change speed of the color temperature may be changed to 50/100 [K/ms]. When brightness of the display image is not changed (NO in step S110), the change speed of the color temperature is not performed. It should be noted that values of the change speed of the color temperature are described above as examples.

After that, unless the color temperature of the environment light change and the display image is switched, the color temperature is being changed at the change speed until the color temperature of the display device 107 reaches the targeted value. When the color temperature of the display device 107 reaches the targeted value (YES in step S112), the color temperature adjustment part 12 stops changing the color temperature of the display device 107 (step S114).

Figure 7A:
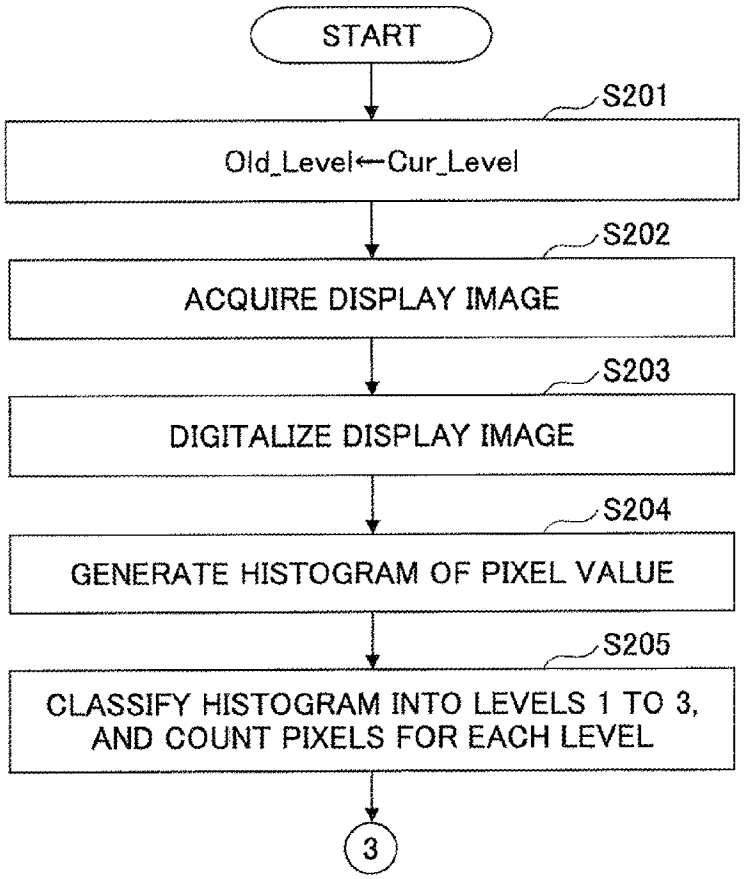
FIG. 7A and FIG. 7B illustrate a flowchart for explaining an example of a process procedure of an analysis process of the display image.
Figure 7B:
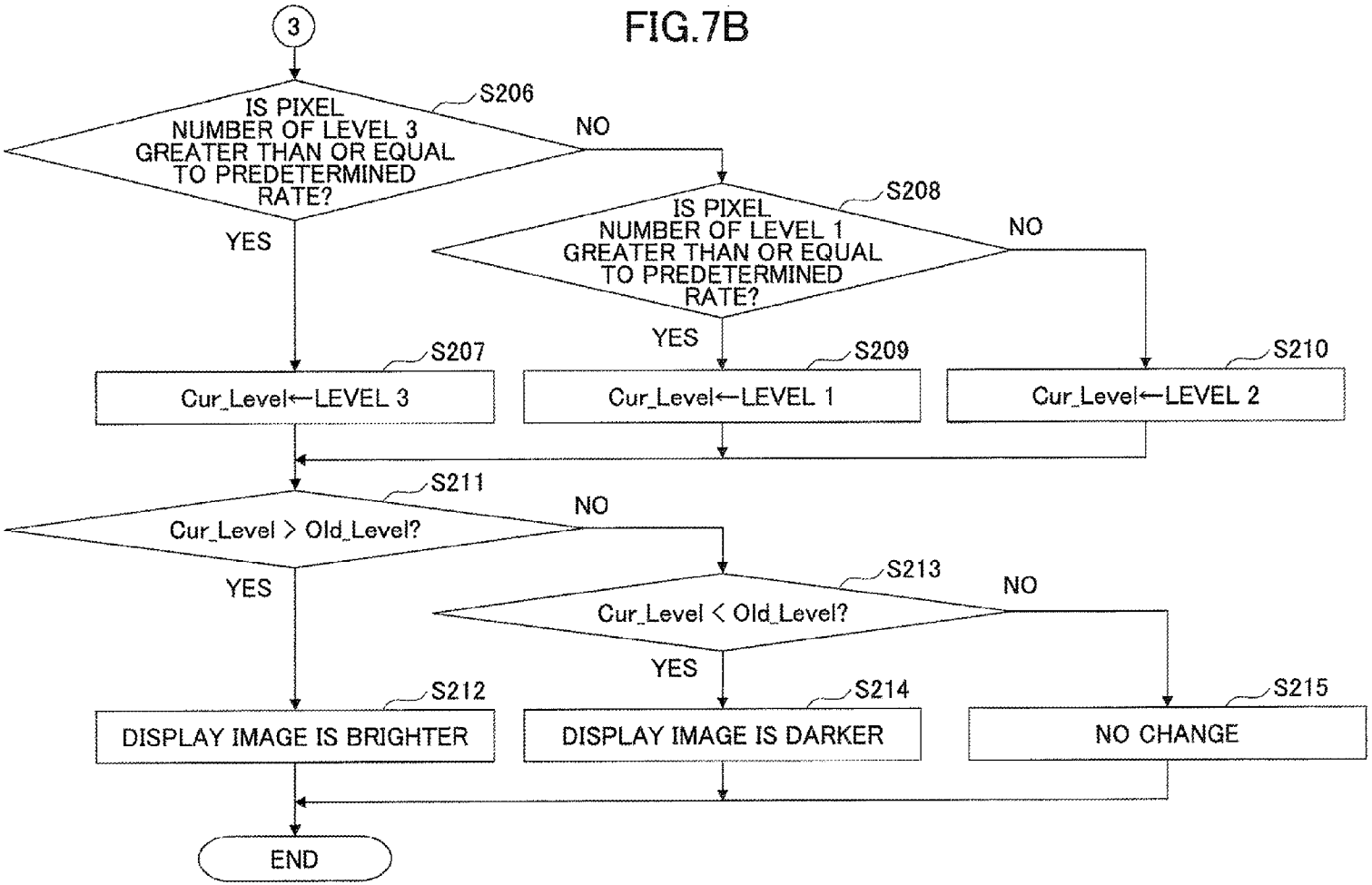

Next, a process in step S107 will be described in detail. FIG. 7A and FIG. 7B illustrate a flowchart for explaining an example of a process procedure of the analysis process of the display image.

In step S201, the image analysis part 13 substitutes a value of a variable Cur_Level into a variable Old_Level. A brightness level of the display image at that time point is set to the variable Cur_Level each time the process in FIG. 7 is performed. Accordingly, in step S201, the brightness level of the display image when the process in FIG. 7 is previously performed, that is, the brightness level of the display image before the display image is switched is saved in the variable Old_Level.

After that, the image analysis part 13 acquires the current display image (step S202). The display image may be acquired from a video memory (not illustrated) in the display device 107.

Next, the image analysis part 13 digitalizes the acquired display image (step S203). As a result, each value of pixels of the display image including values from 0 to 255 for each of red, green, and blue becomes a value (a density value) indicating contrast by tones of 0 to 255. The image is not limited to 256 tones. In the embodiment, it is assumed that a tone 255 indicates black and the darkest tone, and a tone 0 indicates white, and the brightest tone.

Next, the image analysis part 13 analyzes a distribution of the pixel values (density values) of the display image being digitalized, and vertically generates a histogram of the pixel values (step S204). In specific, the image analysis part 13 counts a number of pixels having the same pixel value for each of pixels from 0 to 255.

Figure 8:
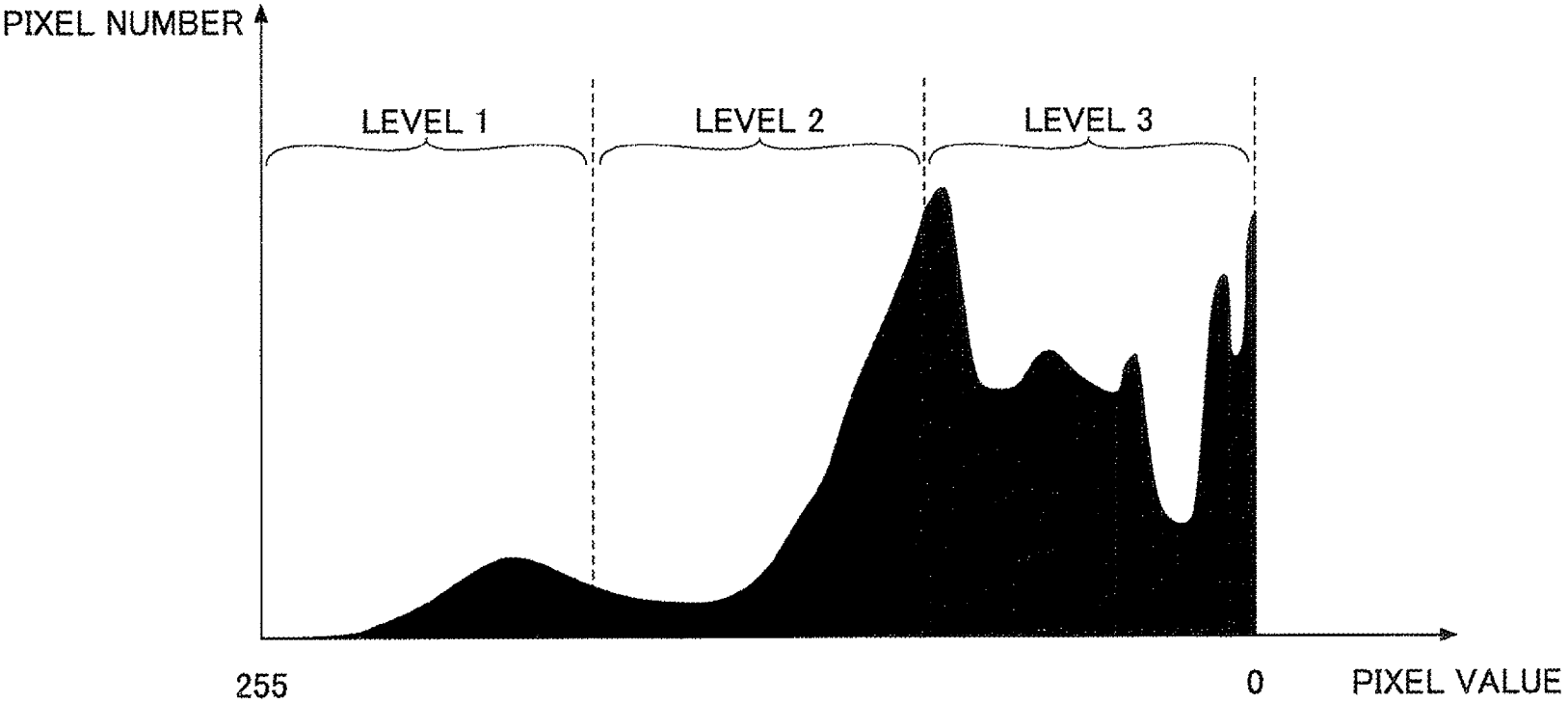
FIG. 8 is a diagram illustrating a first example of a histogram of pixel values.

FIG. 8 is a diagram illustrating a first example of the histogram of the pixel values. In FIG. 8, a count result of a pixel number is depicted for each of the pixel values (density values) from 255 to 0.

After that, the image analysis part 13 divides a range of the pixel values of the histogram into three ranges of level 1 through level 3 sequentially from a dark level (255), and counts the number of pixels included in each level. The graph in FIG. 8 depicts a state of three divisions of level 1 through level 3.

After that, the image analysis part 13 determines whether the pixel number of level 3 indicates a predetermined ratio $\alpha$ (step S206). The predetermined ratio $\alpha$ is preferably set to be a value in which it is assured at 60% or the like for the pixel number of level 3 is greater than each pixel number of other levels. When the pixel number of level 3 is greater than the predetermined ratio α (YES in step S206), the image analysis part 13 substitutes level 3 into the variable Cur_Level (step S207). If the histogram is depicted as illustrated in FIG. 8, level 3 may be substituted into the variable Cur_Level.

When the pixel number of level 3 is not greater than the predetermined ratio α (NO in step S206), the image analysis part 13 determines whether the pixel number of level 1 is greater than the predetermined ratio α (YES in step S208), the image analysis part 13 substitutes level 1 into the variable Cur_Level (step S209). If the histogram is depicted as illustrated in FIG. 9, level 1 may be substituted into the variable Cur_Level.

Figure 9:
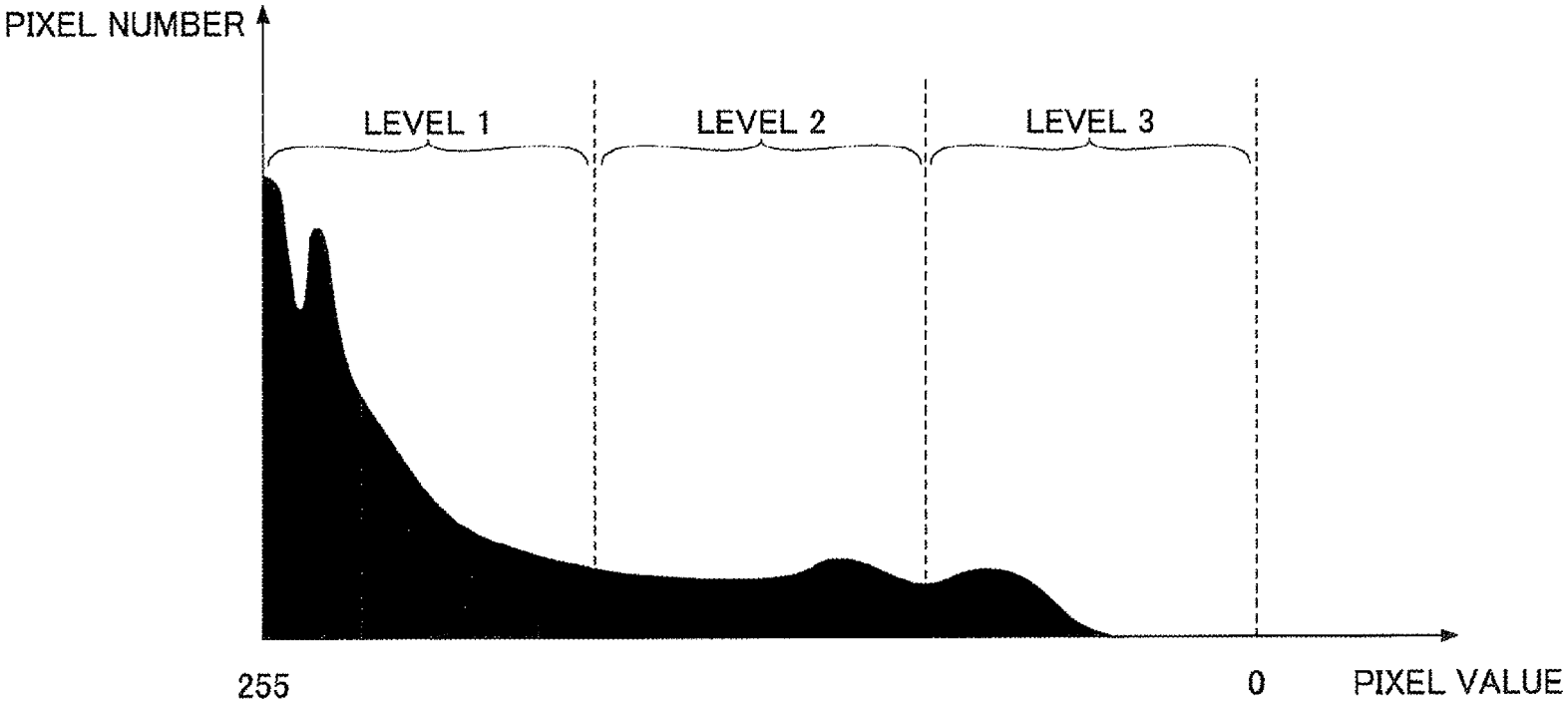
FIG. 9 is a graph illustrating a second example of a histogram of the pixel values.

FIG. 9 is a graph illustrating a second example of the histogram of the pixel values. In FIG. 9, the distribution of the pixel values (density values) is dominate at level 1 (in other words, is concentrated at level 1).

When the pixel number of level 1 is less than or equal to the predetermined ratio α (NO in step S208), the image analysis part 13 substitutes level 2 into the variable Cur_Level (step S210).

After that, the image analysis part 13 determines whether a level indicated by the variable Cur_Level is higher than a level indicated by the variable Old_Level (step S211). A higher level means that a value N indicates a greater number when a level N is denoted. Level 3 may be regarded as a level higher than level 2 and level 1. Accordingly, a determination in step S211 corresponds to a determination whether the display image after the change is brighter than the display image before the change.

When the level indicated by the variable Cur_Level is higher than the level indicated by the variable Old_Level (YES in step S211), the image analysis part 13 determines whether the display image after the change is brighter than the display image before the change (step S212).

When the level indicated by the variable Cur_Level is not higher than the level indicated by the variable Old_Level (NO in step S211), the image analysis part 13 determines whether the level indicated by the variable Cur_Level is lower than the level indicated by the variable Old_Level (step S213). The determination corresponds to a determination whether the display image after the change is darker than the display image before the change.

When the level indicated by the variable Cur_Level is lower than the level indicated by the variable Old_Level (YES in step S213), the image analysis part 13 determines whether the display image after the change is darker than the display image before the change (step S214). When the level indicated by the variable Cur_Level is the same as the level indicated by the variable Old_Level (NO in step S213), the image analysis part 13 determines that there is no brightness change before and after the display image is changed (step S215).

In FIG. 7A and FIG. 7B, the example in which the histogram is divided into three is depicted. Alternatively, the histogram may be divided into more than three to be further segmented. Also, in the determinations of the level of the display image in steps S206, S208, and the like, the ratio of the pixel number for each level is compared with the predetermined ratio α. A level having the greatest pixel number may be specified in all levels. In step S206, it may be determined whether the pixel number of level 3 is the greatest.

As described above, according to the embodiment, when the brightness of the display image changes during the adjustment of the color temperature of the display device 107, an adjustment speed of the color temperature is dynamically changed. Accordingly, it is possible to adjust the color temperature of the display device 107 at a speed suitable for the adjustment of human eyes for the change of brightness and darkness. As a result, it is possible to reduce perceived artificiality of the adjustment of the color temperature of the display device 107.

In the embodiment, the color temperature change detection part 11 is an example of a detection part. The color temperature adjustment part 12 is an example of a change part. The image analysis part 13 is an example of a determination part. The display device 107 is an example of a display part.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An information processing apparatus comprising:

a detection part configured to detect a change of a first color temperature of an external environment;

a change part configured to change a second color temperature of a display part at a predetermined speed to a targeted value corresponding to the first color temperature after the change in response to a detected change of the first color temperature; and a determination part configured to determine whether brightness of an image is changed based on a histogram of pixel values for pixels within the image, in response to a switch of the image on the display part, wherein when it is determined that the brightness of the image on the display part is changed during the change of the second color temperature of the display part, the change part changes the second color temperature of the display part at a different speed from the predetermined speed.

2. The information processing apparatus as claimed in claim 1, wherein when it is determined that the image after the change is darker than the image before the change during the change of the second color temperature of the display part, the change part changes the second color temperature of the display part at slower speed than the predetermined speed.

3. The information processing apparatus as claimed in claim 1, wherein when the image after the change is brighter than the image before the change during the change of the second color temperature of the display part, the change part further changes the second color temperature of the display part at a faster speed than the predetermined speed.

4. The information processing apparatus as claimed in claim 1, wherein the determination part determines the presence or absence of the brightness change of the image based on a difference between levels of the histogram of the pixel values of the image before and after the change.

5. A display control method performed in a computer, the method comprising:

detecting, by the computer, a change of a first color temperature of an external environment;

changing, by the computer, a second color temperature of a display part at a predetermined speed to a targeted value corresponding to the first color temperature after the change in response to a detected change of the first color temperature; and determining, by the computer, whether brightness of an image is changed based on a histogram of pixel values for pixels within the image, in response to a switch of the image on the display part, wherein when it is determined that the brightness of the image on the display part is changed during the change of the second color temperature of the display part, the second color temperature of the display part is changed by the computer at a different speed from the predetermined speed.

6. A non-transitory computer-readable recording medium recorded with a program which, when executed by a computer, causes the computer to perform a display control process comprising:

detecting a change of a first color temperature of an external environment;

changing a second color temperature of a display part at a predetermined speed to a targeted value corresponding to the first color temperature after the change in response to a detected change of the first color temperature; and determining whether brightness of an image is changed based on a histogram of pixel values for pixels within the image, in response to a switch of the image on the display part, wherein when it is determined that the brightness of the image on the display part is changed during the change of the second color temperature of the display part, the second color temperature of the display part is changed at a different speed from the predetermined speed.

* * * * *